US006848637B2

(12) United States Patent
Holtsnider

(10) Patent No.: US 6,848,637 B2
(45) Date of Patent: Feb. 1, 2005

(54) HYDROTHERAPY JET WITH ROTATING OUTLET

(75) Inventor: Michael D. Holtsnider, Moorpark, CA (US)

(73) Assignee: Waterway Plastics, Inc., Oxnard, CA (US)

( * ) Notice: Subject to any disclaimer, the term of this patent is extended or adjusted under 35 U.S.C. 154(b) by 0 days.

(21) Appl. No.: 10/164,025

(22) Filed: Jun. 5, 2002

(65) Prior Publication Data

US 2003/0226199 A1 Dec. 11, 2003

(51) Int. Cl.[7] ..... B05B 15/08
(52) U.S. Cl. ..... 239/587.1; 239/492; 4/541.6
(58) Field of Search ..... 239/492, 587.1, 239/423; 4/541.4, 541.6; 285/81

(56) References Cited

U.S. PATENT DOCUMENTS

| | | | | |
|---|---|---|---|---|
| 4,101,075 A | * | 7/1978 | Heitzman | 239/101 |
| 4,508,665 A | | 4/1985 | Spinnett | 261/93 |
| 4,559,653 A | | 12/1985 | Mathews | 4/541 |
| 4,823,413 A | * | 4/1989 | Chalberg et al. | 4/541.4 |
| 5,014,372 A | | 5/1991 | Thrasher et al. | 4/542 |
| 5,226,601 A | | 7/1993 | Hinojosa, Jr. et al. | 239/423 |
| 5,269,029 A | | 12/1993 | Spears et al. | 4/541.6 |
| 5,271,561 A | | 12/1993 | Tobias et al. | 239/289 |
| 5,291,621 A | | 3/1994 | Mathis | 4/541.4 |
| 5,353,447 A | | 10/1994 | Gravatt | 4/541.6 |
| 5,657,496 A | | 8/1997 | Corb et al. | 4/541.6 |
| 5,742,953 A | | 4/1998 | Loizeaux et al. | 4/541.1 |
| 5,810,257 A | | 9/1998 | Ton | 239/259 |
| 5,862,543 A | * | 1/1999 | Reynoso et al. | 4/541.6 |
| 5,920,925 A | | 7/1999 | Dongo | 4/541.6 |
| 6,178,570 B1 | * | 1/2001 | Denst et al. | 4/541.6 |
| 6,254,014 B1 | | 7/2001 | Clearman et al. | 239/222.15 |
| 6,334,224 B1 | | 1/2002 | Chalberg et al. | 4/541.6 |
| 6,510,277 B1 | * | 1/2003 | Dongo | 385/147 |

OTHER PUBLICATIONS

Hydro Air SPA Products, Data Sheet for Stacked Jet Assemblies, p. S–13, (Jan. 2000).

Waterway Plastics Inc., "1999 Product Catalog", p. 4, including part Nos. 210–6120 and 210–6510.

* cited by examiner

*Primary Examiner*—Henry Bennett
*Assistant Examiner*—Amanda Flynn
(74) *Attorney, Agent, or Firm*—Koppel, Jacobs, Patrick & Heybl

(57) ABSTRACT

A hydrotherapy jet is disclosed which has a jet body with a water inlet to allow water to flow into it. An eyeball with one or more outlets is mounted to the body to allow water to flow out of the body through the outlets. The flow of water through the outlets causes the eyeball to rotate. A retaining pin is mounted within the jet body to hold the eyeball to the body, with the eyeball rotating around said pin. A system for providing a hydrotherapy jet to reservoir of water is also disclosed and includes a reservoir shell capable of holding water with a plurality of hydrotherapy jets according to the invention that are mounted around the reservoir shell. A water pump system circulates water from the reservoir to said jets.

32 Claims, 13 Drawing Sheets

HYDROTHERAPY JET WITH ROTATING OUTLET

BACKGROUND OF THE INVENTION

1. Field of the Invention

This invention relates to hydrotherapy jets.

2. Description of the Related Art

Various hydrotherapy jets have been developed for use in spas, hot tubs, pools and bath tubs that discharge a stream of water, which can be aerated through a variety of discharge nozzles. The designs provide different flow characteristics that result in different massage affects being experienced by the body. Such jets have been found to produce a pleasing massaging effect for many users, and have become quite popular. In the design of single or multi-user spas or tubs, it is common to use a variety of different jet nozzles to provide a variety of different massaging effects.

Early jets simply discharged a steam of warm water along the longitudinal axis of the jet body, with later jets providing aeration of the water stream. Since then, numerous jets have been developed in which the direction of the stream can be adjusted. For example, U.S. Pat. No. 5,269,029 to Spears et al. (assigned to the same assignee as the present invention) discloses a jet that provides an off axis stream of water and has an axial push/pull mechanism used to control the flow of water. The mechanism can also be rotated to rotate the stream of water around the jet axis, providing directional control over the stream.

Jets have also been developed having a rotating outlet or eyeball that automatically rotates in response to the water flowing through the outlet. See Waterway Plastics Inc., "1999 Product Catalog," Page 4, including Part Nos 210–6120 and 210–6510. The jet produces a water jet that passes through the outlet, and the outlet can be adjusted off the jet's longitudinal axis to provide a turning moment in the eyeball in response to the jet flow.

U.S. Pat. No. 6,178,570 to Denst et al. (assigned to the same assignee as the present invention) discloses a jet having a rotating eyeball with one or more discharge outlets that can be adjusted to vary the direction of the outlet flow stream as well as the direction and speed of the eyeball's rotation. A high-pressure water stream flows through the outlets and, depending upon the orientation of the outlets, the eyeball can rotate clockwise or counterclockwise at different speeds.

U.S. Pat. No. 5,920,925, to Dongo (assigned to the same assignee as the present invention) discloses a jet having a rotating eyeball and a diverter cap formed with a number of bore holes positioned at a common radius from the center of the cap. The jet produces a high pressure water jet that flows through the eyeball, causing it to rotate at a high speed and discharge the jet in a circular pattern that impinges on the bore holes. Together, the rotational speed and the bore hole design produce the sensation of a number of simultaneously pulsating water jets that are directed into the spa.

One disadvantage of these rotating jets is that they rely on internal bearings to allow the outlet or eyeball to rotate. This approach is effective in allowing free rotation, but the bearings are relatively expensive and add complexity in design and manufacturing of the jets. Also, calcium can build up on the bearings from water and over time the build-up can prevent the free rotation of the outlet.

U.S. Pat. No. 5,226,601 to Hinojosa Jr. et al. (assigned to the same assignee as the present invention) describes a jet with an alternative mechanism for allowing an outlet or eyeball to rotate. A bridge stretches across the front face of the jet and includes a rearward-directed cup mounted at the center of the bridge along the jets longitudinal axis. The cup holds a bushing, which in turn holds a pin. The pin extends into a corresponding opening in the front end of the eyeball to hold it in place. The eyeball rotates in response to a steam of water passing through it by having its outlet angled to the jet's longitudinal axis.

One disadvantage of this arrangement is that the bridge adds to the cost and complexity of the jet's design and manufacture. Also, the jet usually includes one or more internal nozzles that form the stream of water flowing through the jet into a venturi. This allows air to be entrained into the stream of water to provide a aerated stream. However, the vacuum effect of the venturi tends to pull the outlet toward the back of the jet. As a result, the pin/bushing combination must hold the eyeball within the cup against the pull of the venturi vacuum, which makes the bridge type jet even more difficult to design and manufacture. Also, the bridge interferes with the stream of the water from the rotating outlet as it passes under the arms of the bridge. This results in multiple interruptions in the flow of water, which may be undesirable in some circumstances.

U.S. Pat. No. 5,291,621 to Mathis describes a spa jet assembly having a pin shaft that extends along the entire length of the jet. It is held in a circular opening in the rear most surhce of the jet by a pop rivet. The pin passes through a jet head with the jet head being held by a pop rivet, so that there are opposing pop rivets on the pin.

On disadvantage of this jet arrangement is that if the rear of the jet is used as the water inlet, a significant portion of the inlet is blocked by a rear axial surface that supports the circular opening. This restricts the amount of water that can pass into the jet and creates turbulence in the water that does pass. If the rear of the jet is not used as a water inlet, such as in jets with side water inlets, the rivet and pin passing through the rear of the jet, which creates an opening through which water can leak.

SUMMARY OF THE INVENTION

The present invention seeks to provide a hydrotherapy jet with an improved mechanism to allow the jet's outlet to rotate, the mechanism being less complex, less expensive and more durable. The invention also seeks to provide a hydrotherapy jet having outlets that rotate without relying on bearings while at the same time avoiding structures that interfere with the flow of water through the inlet and from the outlets.

These goals are realized with a retaining pin that is mounted within the jet body to hold the eyeball to the body, with the eyeball rotating around the pin. A plurality of such hydrotherapy jets can be mounted around a reservoir shell such as a spa or tub, with a water pump system circulating water from the reservoir to each of the jets.

These and other further features and advantages of the invention will be apparent to those skilled in the art from the following detailed description, taken together with the accompanying drawings, in which:

DETAILED DESCRIPTION OF THE INVENTION

Figure 1:
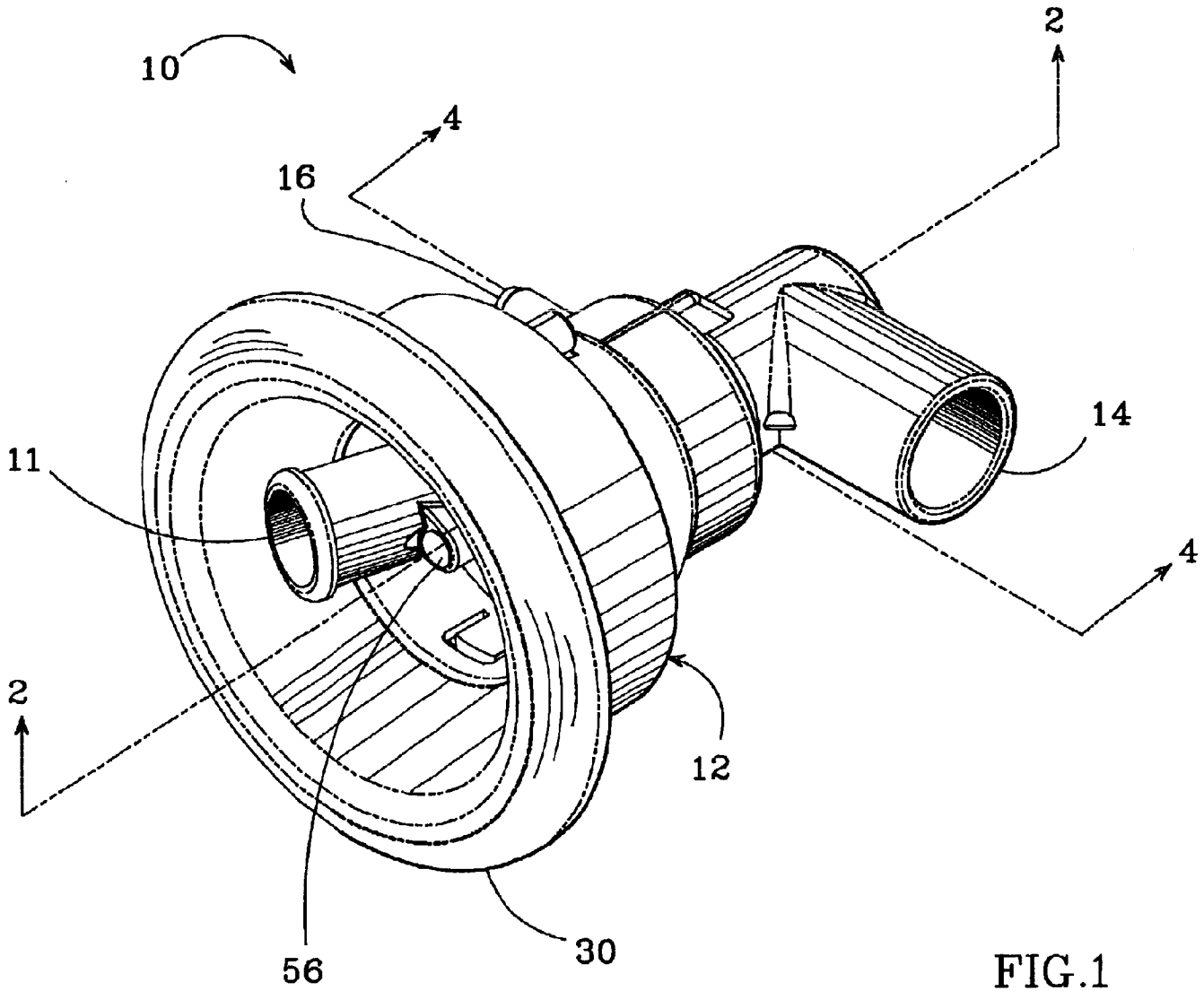
FIG. 1 is a perspective view of an embodiment of a single outlet hydrotherapy jet according to the present invention.
Figure 2:
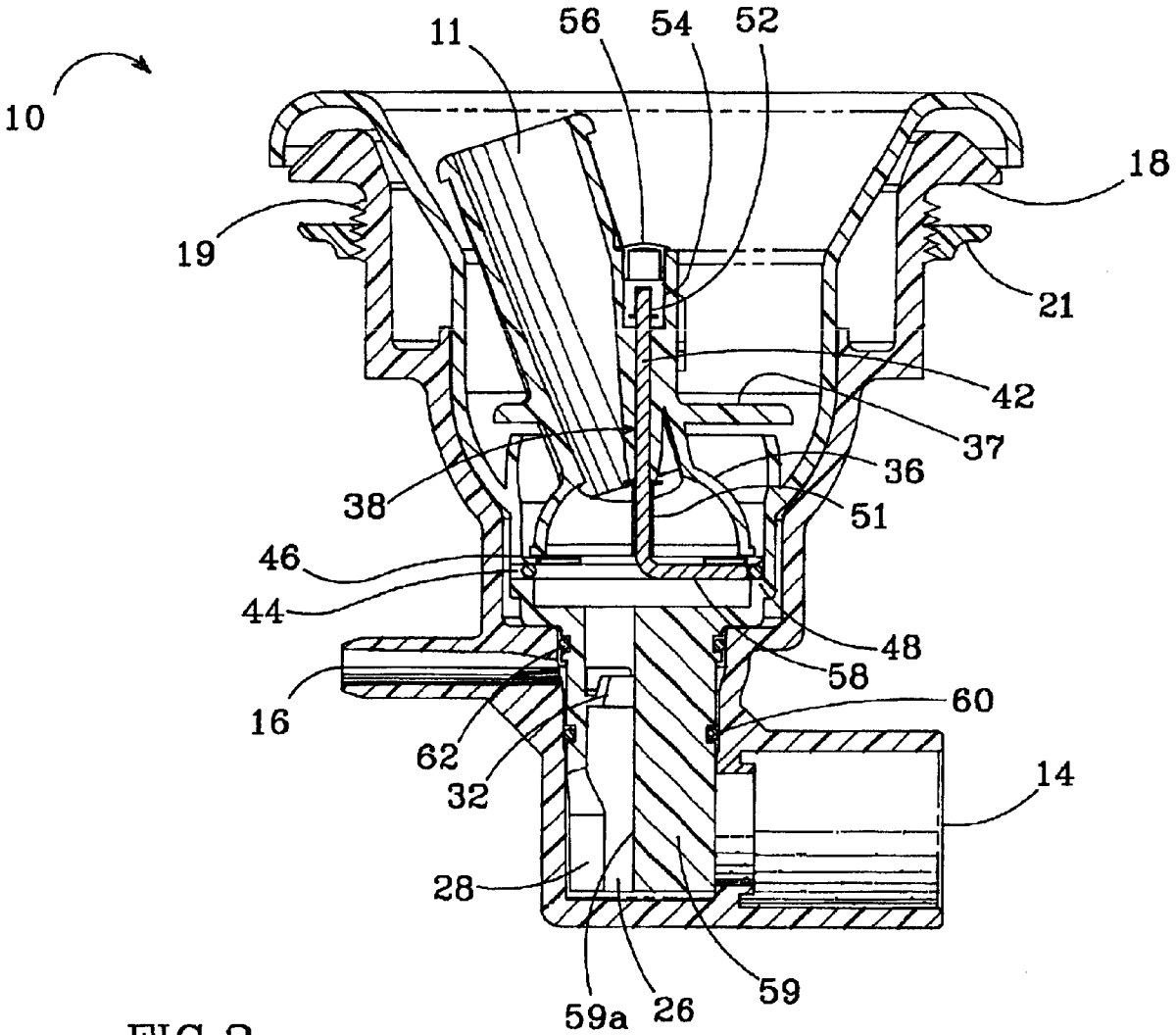
FIG. 2 is a sectional view of the jet show in FIG. 1, taken along section lines 2—2.
Figures 3, 4:
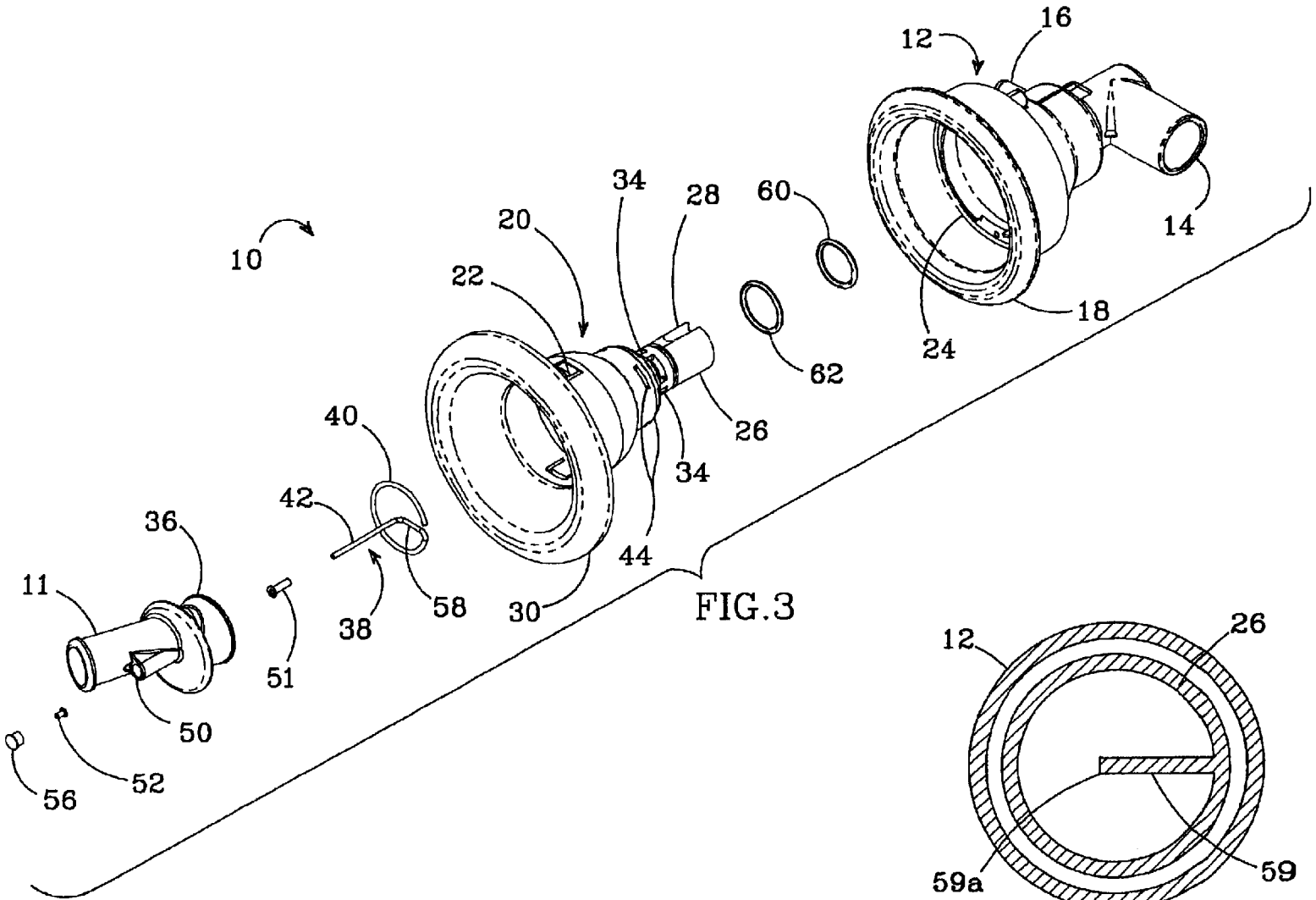
FIG. 3 is an exploded view of the jet in FIG. 1.
FIG. 4 is a sectional view of the jet in FIG. 1, taken along section lines 4—4.

FIGS. 1–3 show one embodiment of a hydrotherapy jet 10 constructed in accordance with the present invention, having a rotating outlet 11. The jet 10 and its components are preferably formed from a water impervious plastic such as ABS, PVC or CPVC. It is particularly adapted to be positioned below the water level on the spa or tub wall, with the majority of the jet positioned behind the spa's water contacting wall.

The jet 10 includes a jet body 12 having a water inlet 14 that receives a standard water supply tube. The body 12 can also have an air inlet tube 16 to allow air into the body 12 in applications where aerated water is desired. The jet body 12 has an external flange 18 that is positioned on the spa's water contacting wall. The outside surface of the body 12, adjacent to the flange 18, has a threaded section 19 for mating with the threads of a wall fitting 21. A circular gasket or other devices or compounds that provide a watertight seal (not shown) can be on the wall fitting 21 and/or flange 18 to provide a seal with the wall. The fitting 21 is rotated until the flange 18 tightens against the spa wall. The jet 10 is held securely in place with the spa wall sandwiched between the flange 18 and the fitting 21.

The jet body 12 houses an internal escutcheon 20 that is mounted within the body 12 by escutcheon tabs 22 (shown in FIG. 3). The front edge of each tab 22 projects slightly outward and, as the escutcheon is inserted into the body 12, the tabs 22 are compressed in toward the jet's longitudinal axis. When the tabs 22 pass a lip 24 one the jet body's internal surface, they expand to their projected position so that the escutcheon 20 is held in the body 12 by the front edges of the tabs 22 butting against the lip 24. This arrangement allows for the escutcheon 20 to rotate within the body 12 with the front edges of the tabs 22 sliding on the lip 24. In the jet 10 the escutcheon 20 is one unit, but for ease of molding or manufacture it could also be made of multiple pieces that are bonded, fitted or mounted together.

The escutcheon 20 includes a cylindrical nozzle 26 at its base, which has a nozzle opening 28 to allow water from the inlet pipe 14 into the nozzle 26. When the jet is installed in a spa, a spa occupant can control the amount of water that passes into the nozzle 26 by grasping the escutcheon flange 30 and rotating the escutcheon 20 within the body, which changes the alignment of the opening 28 with the inlet 14. When the opening 28 is fully aligned with the inlet 14, the maximum amount of water enters the nozzle 26, which causes the outlet 11 to rotate at its maximum speed. Moving the opening 28 out of alignment with the inlet 14 reduces the amount of water entering the nozzle, which reduces the rotational speed of the outlet 11. When the opening 28 is moved completely out of alignment with the inlet 14, no water enters the nozzle 26 and the outlet 11 does not rotate.

The interior surface of the nozzle 26 has a venturi section 32 (shown in FIG. 2) that tapers slightly to accelerate the water flowing through the nozzle, creating a venturi jet. Forward of the venturi section 32 are axial air passageways 34 (shown in FIG. 3). Air enters the jet body 12 through the air inlet 16 and the air can then flow to the forward end of the venturi section 32 through the passageways 34. At that location, air is entrained into the water jet due to the venturi action, producing a jet with a desirable water/air mixture.

The outlet 11 is molded onto an eyeball 36 which is housed within the escutcheon 20. The jet from the nozzle 26 passes into the eyeball 36, through the outlet 11 and into the spa. The outlet 11 is angled off the longitudinal axis of the jet 10, to provide a turning moment in the eyeball 36 in response to the jet flow, causing the eyeball 36 to rotate. The eyeball 36 includes an integral disk 37, which is included for aesthetics to hide the eyeball 36 from the spa occupants.

The jet as described thus far is conventional and numerous modifications may be made to the manner in which water enters or flows through it. The invention involves the retention of the outlet within the jet body. In particular embodiment, the eyeball 36 is held within the escutcheon 20 by a retaining pin 38, which can be made of many different materials, but is preferably made of a metal. It generally comprises a retaining section, implemented in this embodiment by a circular base 40 which comprises a single turn of a coil spring, and an elongated axial section 42. The base 40 holds the pin 38 within the escutcheon by being slightly compressed when inserted into the escutcheon during assembly of the jet, exerting an outward spring force. The escutcheon 20 has a series of axial slots 44 that each have a lip 46 on its forward edge. When the pin 38 is inserted in the body 12, the pin base 40 passes over the lips 46 slightly compressing the base 40. When the base passes over the lips 46, it expands to holding the base 46 adjacent to the slots, between the lips 46 and an escutcheon ledge 48.

The pin's axial section 42 is arranged along the jet's longitudinal axis. The outlet or eyeball 36 is mounted on the pin 38 by passing the axial section 42 through central 50 in the eyeball. A bushing 51 is also included around the pin's axial section 42 between it's base 40 and the bottom of the central bore 50. The bushing 51 prevents the base of the eyeball 36 from striking the base 40 when it is spinning. This is primarily useful for free spinning the outlet 11 by hand when no water is flowing through the jet 10. When water is flowing, the pressure from the water stream forces the outlet forward to provide a space between the eyeball 36 and pin base 40.

The outlet can be held on the pin by various devices such as a press nut, cotter pin, clip, nut or bolt, with a preferred device being a rivet 52 that is mounted at the end of the pin's axial section. The rivet head is wider than the diameter of the central bore 50 and retains the eyeball 36 on the pin 38. The forward portion of the bore 50 has a larger diameter than the remainder of the bore. The rivet (or other retaining device) 52 is housed within the enlarged portion 54, with the eyeball 36 rotating around the rivet 52 without the rivet hitting the walls of the enlarged portion 54. A cap 56 is than placed over the enlarged bore portion 54 to hide the retaining device 52 and protect it from water.

The pin's base 40 a connecting strut 58 that connects it to the axial pin section 42. This strut can interfere with the flow of water from the nozzle 26, causing splashing within the eyeball. Such internal splashing can in turn interfere with the smooth flow of water through the outlet 11. Referring now to FIGS. 2 and 4, to prevent this internal splashing the nozzle 26 can have a fin 59 that extends from the nozzle's inner surface to the jet's longitudinal axis, with the fin's inner edge 59*a* extending slightly beyond the axis. The fin 59 has a thickness approximately equal to the diameter of the strut 58. When the jet is assembled, the fin 59 is aligned with the strut 58 so that as water passes through the nozzle 26 the fin 59 produces a gap in the stream of water immediately downstream of the fin in the vicinity of the strut 58. The gap is aligned with the strut 58 and as a result, water does not significantly strike the strut, avoiding the internal splashing.

An O-ring 60 provides a seal between the body 12 and the escutcheon 20 to prevent water from flowing between the two from the rear of the jet 10 towards the front. At the same time, a second O-ring 62 provides a seal between the body 12 and the escutcheon 20 forward of O-ring 60 to prevent water from flowing between the two from the front of the jet 10 towards the rear. This O-ring arrangement blocks water from entering the air inlet tube 16 and from passing through the air passageways 34.

In operation, water enters the body 12 through the inlet 14 and passes into the nozzle 26, with the amount of water entering depending on the alignment of the nozzle opening 28 and the inlet 14. As the water passes through the nozzle 26 a gap is formed in the stream by the fin 59. The nozzle's tapered section forms a venturi and air is entrained into the nozzle's water stream to form a aerated jet. This jet passes into the eyeball 38 and passes through the outlet 11, which causing the eyeball to rotate about the pin 38. The rivet 52 or other retaining device prevents the outlet from being pushed off the pin by the force of the water flow. If desired, a bearing can be provided between the retainer and the base of the enlarged bore portion 54 to facilitate a very low friction rotation of the outlet.

Figure 5:
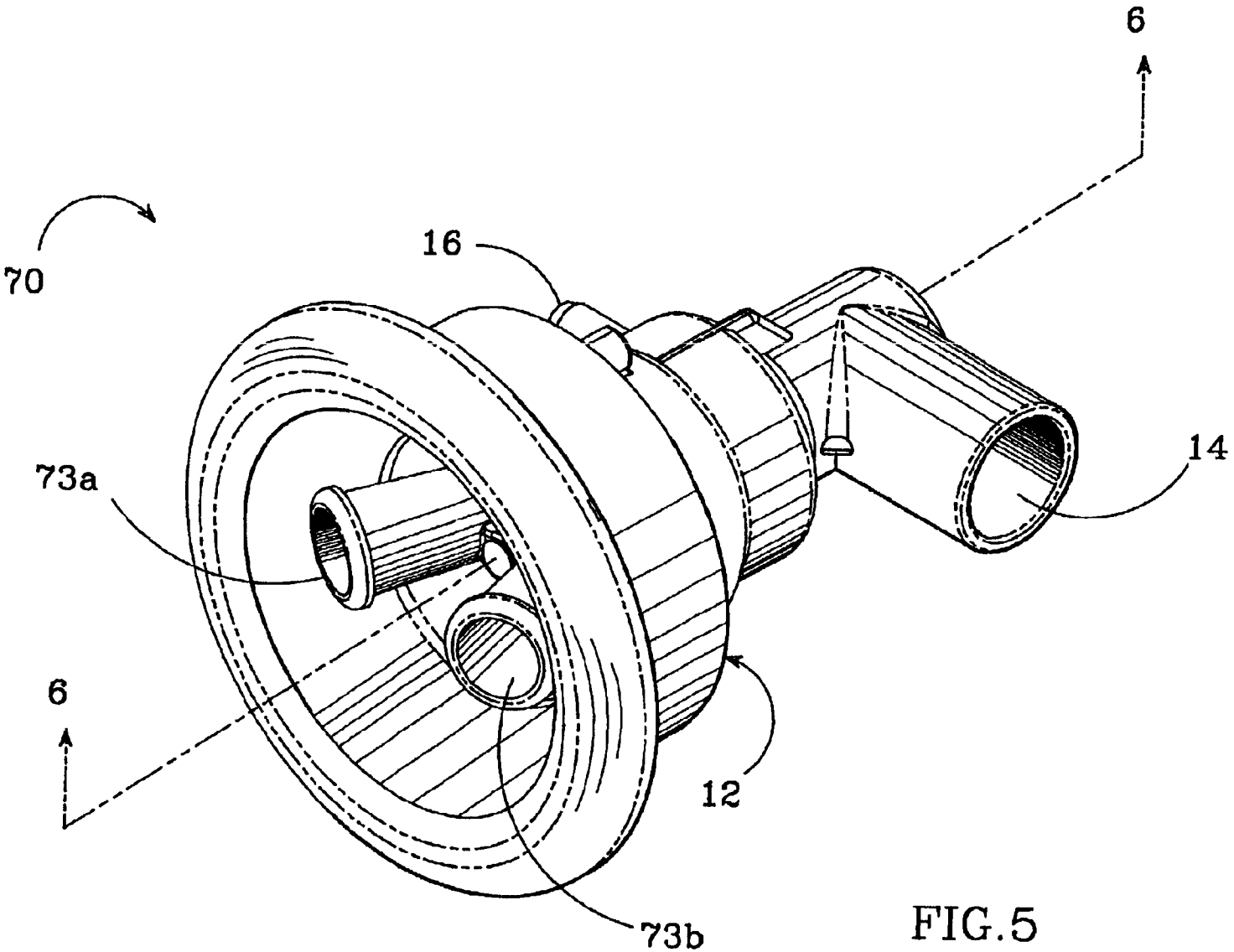
FIG. 5 is a perspective view of an embodiment of a double outlet hydrotherapy jet according to the present invention.
Figure 6:
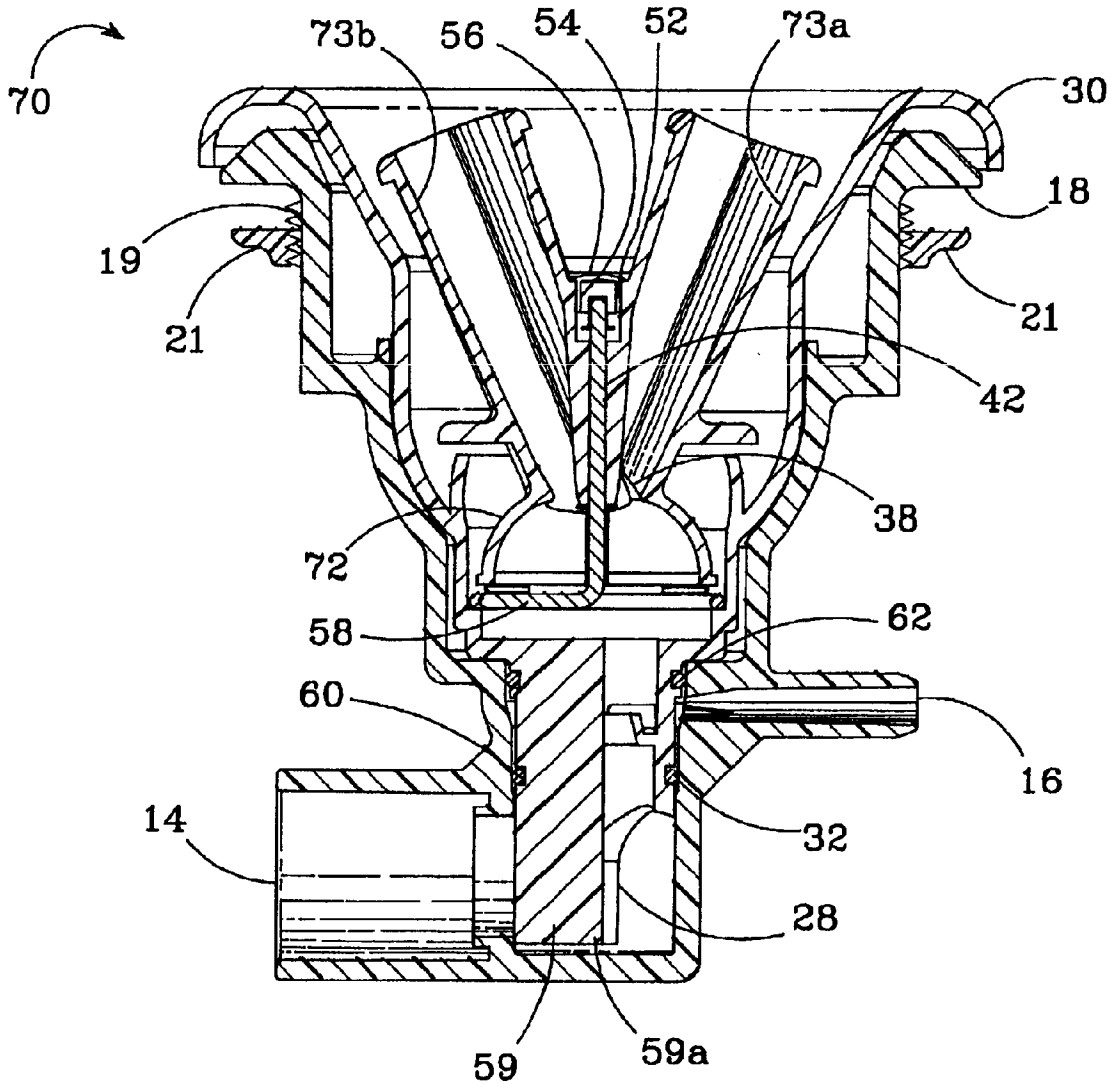
FIG. 6 is a sectional view of the jet show in FIG. 5, taken along section lines 6—6.
Figure 7:
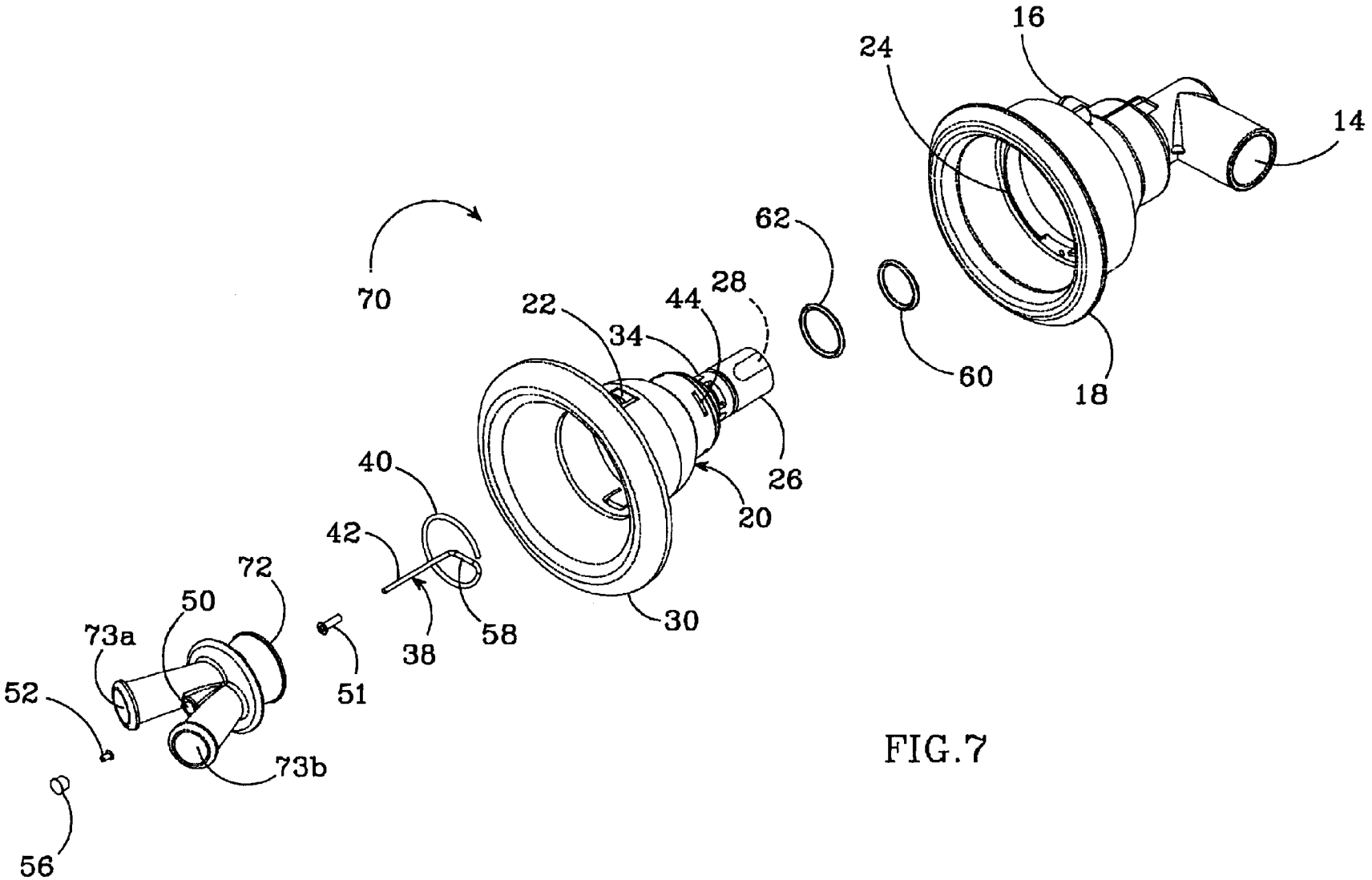
FIG. 7 is an exploded view of the jet in FIG. 5.

FIGS. 5–7 show another jet 70 according to the present invention having most of the same components as the jet 10. The primary difference between the two is that jet 70 has an eyeball 72 with two outlets 73*a*, 73*b*. The jet 70 operates much the same way as jet 10 and his the same pin 38 to retain the eyeball 72 within the body 12. It also has a fin 59 to produce a gap in the nozzle's water stream to prevent internal splashing by the water stream by striking the strut 58. Water enters the jet 70 through the inlet and passes through the nozzle, which forms a venturi to entrain air into the water stream. The aerated stream enters the eyeball 70 and water is diverted into the two outlets 73*a* and 73*b*. The outlets are angled off the jet's longitudinal axis causing the outlet assembly to rotate. The pin's axial portion 42 extends between the two outlets 73*a* and 73*b*, with the retainer 52 also located between the two.

Figure 8:
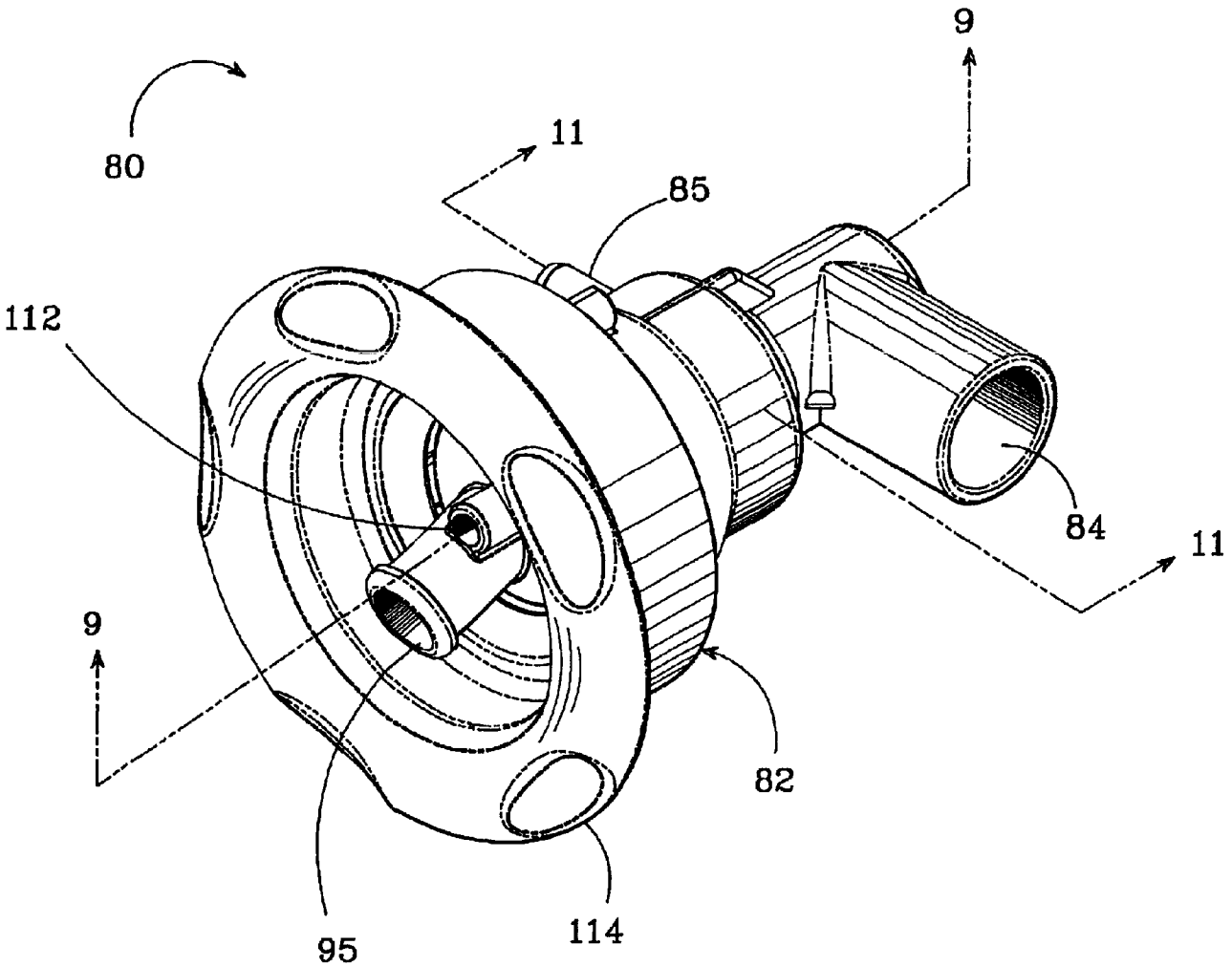
FIG. 8 is a perspective view of another embodiment of a single outlet hydrotherapy jet according to the present invention.
Figure 9:
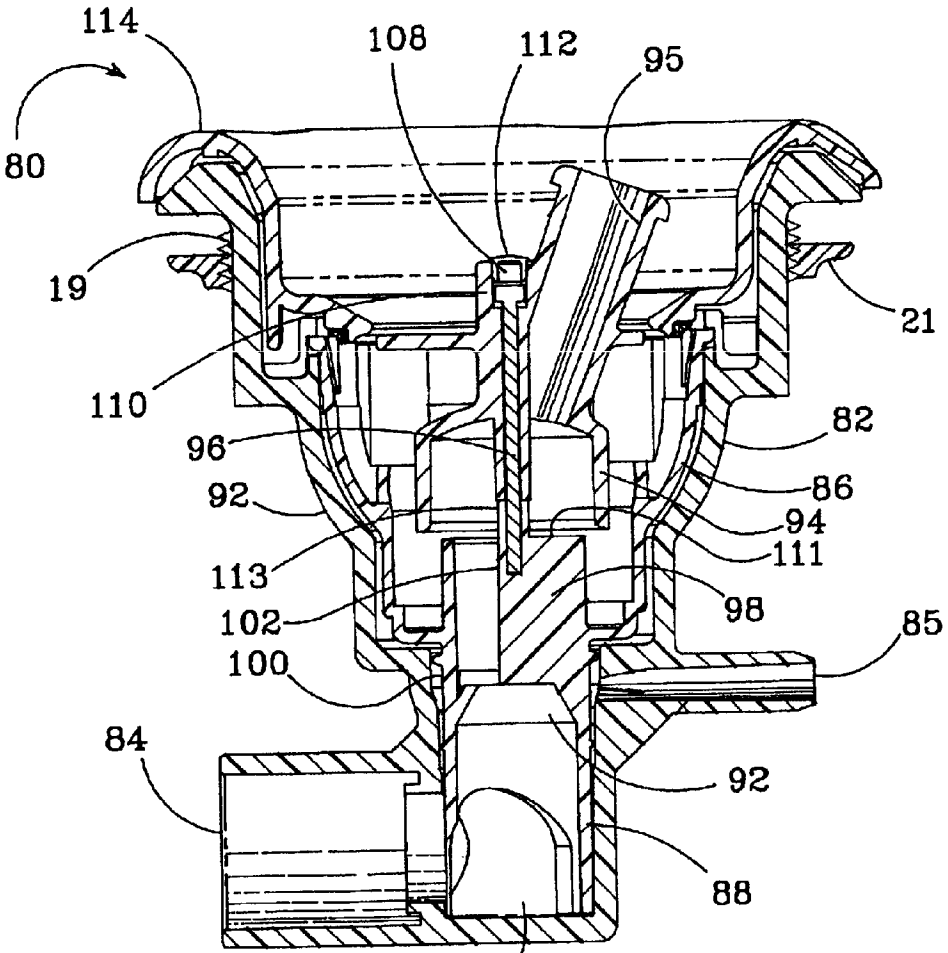
FIG. 9 is a sectional view of the jet in FIG. 8, taken along section lines 9—9.
Figure 10:
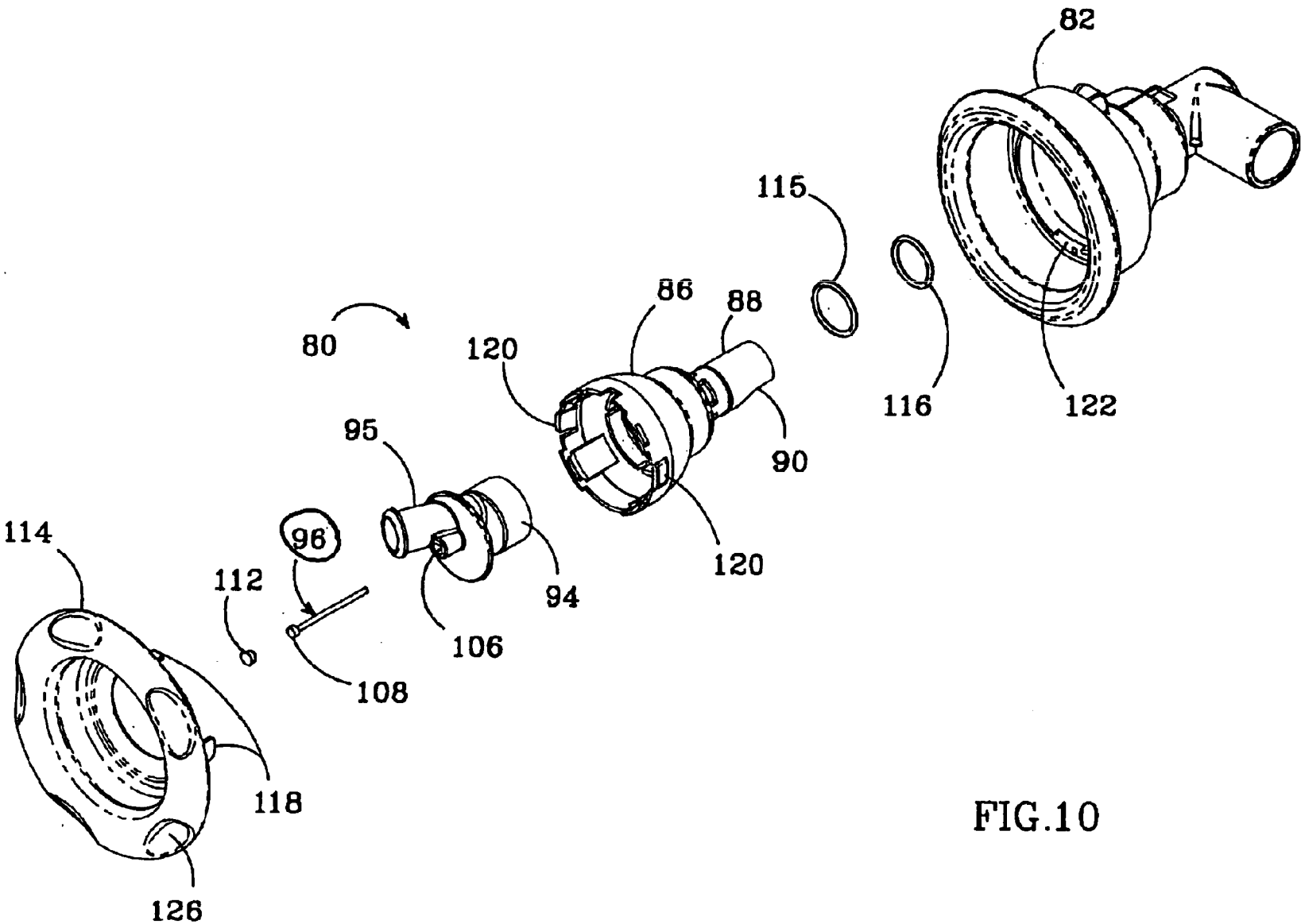
FIG. 10 is an exploded view of the jet in FIG. 8.

FIGS. 8–10 show another jet 80 according to the present invention that is similar to jet 10, with the primary difference being its pin/eyeball arrangement. It includes a jet body 82 with water and air inlets 84, 85, and an escutcheon 86 housed within the body 82. The escutcheon 86 has a nozzle 88 and nozzle opening 90 that fully or partially aligns with the inlet 84 to allow water into the nozzle. The nozzle 88 has a tapered section 92 to form the water into a venturi so that air passing into the body through the air inlet can be entrained into the water stream. Water then flows into the eyeball 94 and into the off-angle outlet 95, causing the eyeball 94 to rotate. Instead of the coil spring base used to support the rotation pin in the embodiments of FIGS. 1–7, the jet shown in FIGS. 8–11 supports an outlet rotation pin 96 with a fin 98 the extends inward from a forward extension 100 of the nozzle to, and slightly past, the jet's longitudinal axis.

Figure 11:
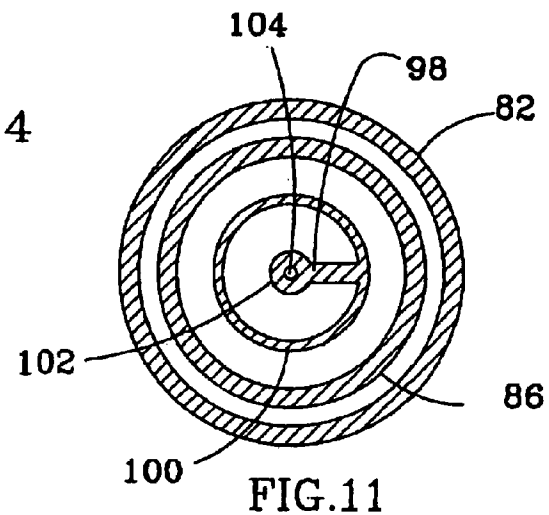
FIG. 11 is a sectional view of the jet in FIG. 8, taken along section lines 11—11.

Referring now to FIG. 11, the fin 98 is not designed to produce a gap in the jet's water stream since the rotation fin does not include a transverse strut that can cause splashing, but instead holds the pin 96. The fin's inner edge is enlarged to an elongate cylinder 102 with a pin hole 104 along the jet axis for receiving the lower end of the rotation pin 96. The eyeball 94 has a central bore 106 and the rotation pin 96 passes to be press-fit into the pin hole 104. The pin 96 can also be attached by many other methods such bonding or threading into the pin hole 104. The pin 96 can also have axial teeth on the section that is press fit into the hole 104 to help hold the pin therein.

The preferred pin 96 has a head 108 to that is housed within the enlarged upper section 110 of the eyeball's central bore 106, with the head 108 having a larger diameter than the remainder of the central hole 106 to hold the eyeball 94 in the body 82. In other embodiments the pin could have a rivet, canter nut, cotter pin, clip, nut or bolt to hold the eyeball 94. A cap 112 is press fit or bonded over the enlarged section 110 to hide the head 108 and to protect it from water.

The fin's elongate cylinder 102, which retains the pin 98, can extend forward beyond the fin's forward edge 111 toward the front of the jet 80 to provide a bushing 113 between the base of the eyeball 94 and the fin edge 112. This allows the eyeball 94 to rotate freely without interfering with the fin 98.

Figure 14:
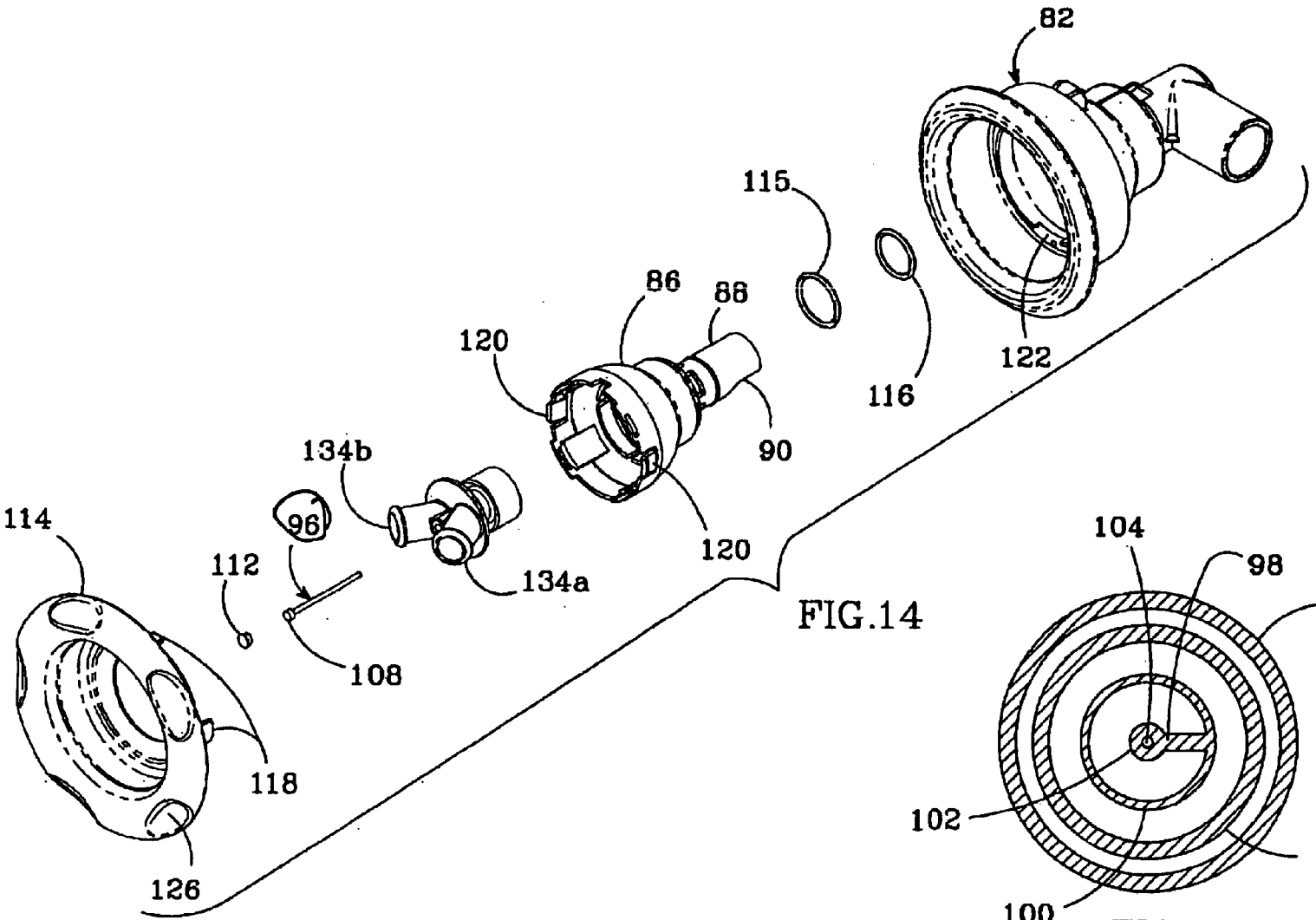
FIG. 14 is an exploded view of the jet in FIG. 12.
Figure 12:
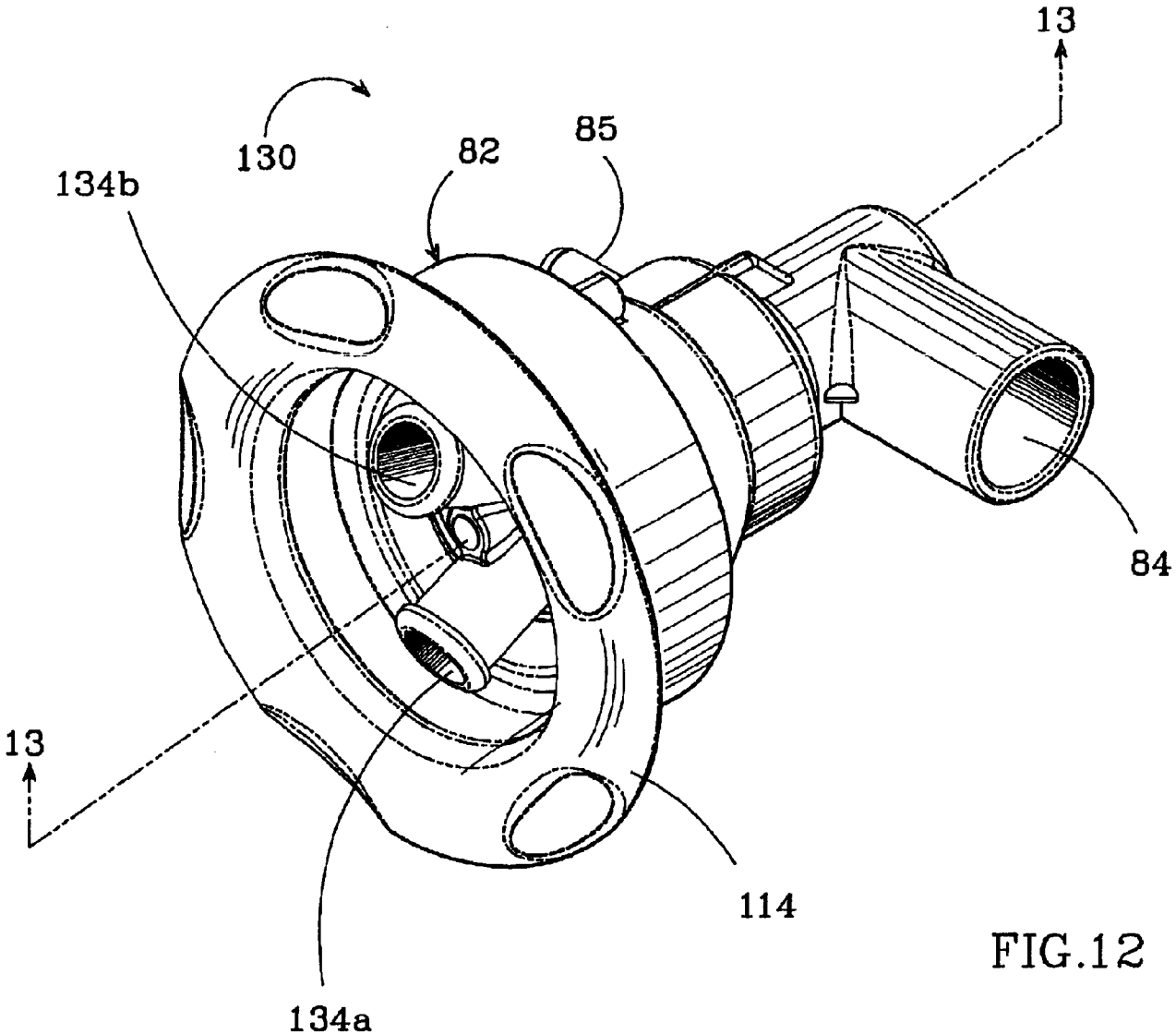
FIG. 12 is a perspective view of another embodiment of a double outlet hydrotherapy jet according to the present invention.
Figure 13:
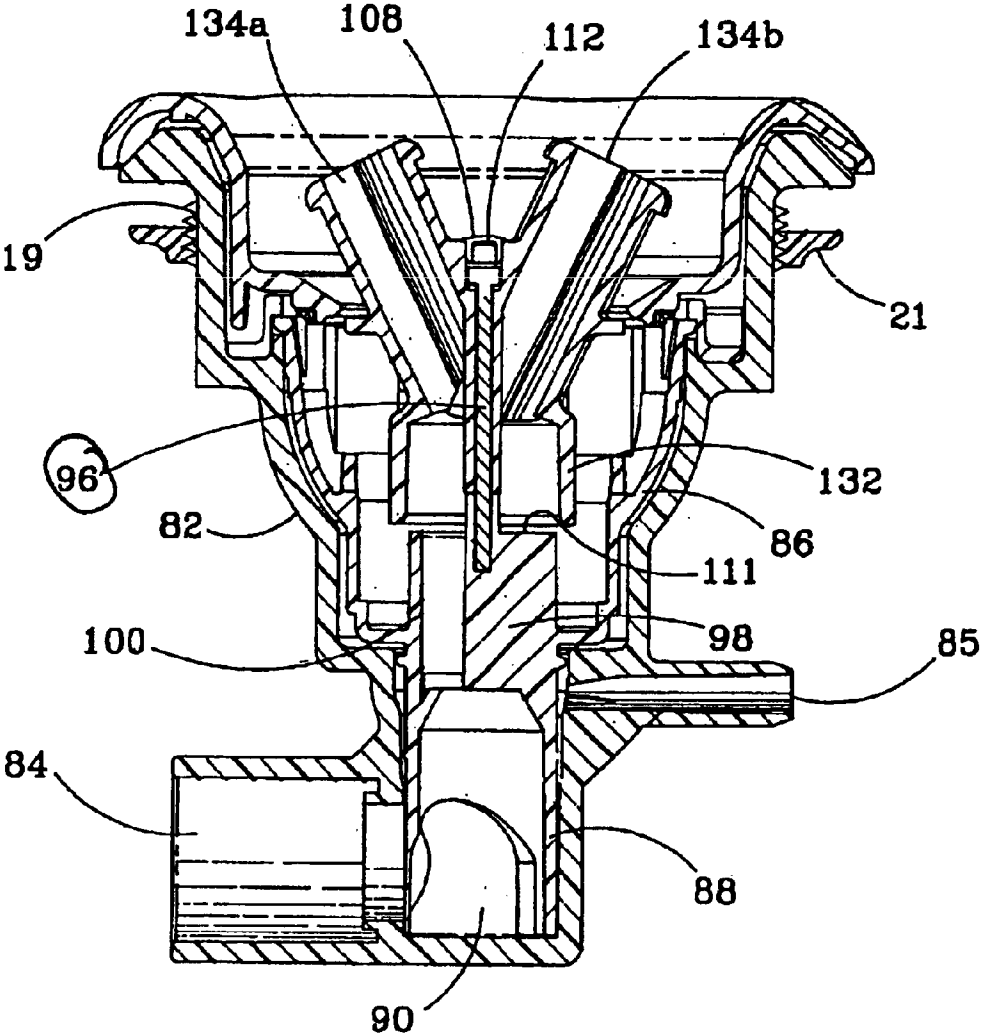
FIG. 13 is a sectional view of the jet show in FIG. 12, taken along section lines 13—13.

Another difference in jet 80 compared to the other jets described previously is that escutcheon 86 has an escutcheon flange 114 that is molded separately. The flange 114 has fingers 118 that fit into mating slots in the escutcheon, snapping the two together. The escutcheon/flange assembly is mounted in the body 82 by flexible escutcheon tabs 120 that butt against an internal ledge 122 on the jet body, similar to the tabs 22 in jet 10 described above. The flange 114 has depressions 126 that make it easier for spa occupants to grasp and turn to control the amount of water passing through the jet 80. The jet 80 also has two O-rings 115, 116, arranged to prevent water from flowing into the air inlet 85 or into the air flow aerating the stream of water. FIGS. 12 through 14 show another jet 130 according to the present invention that is similar to jet 80, but has an eyeball 132 with two outlets 134*a*, 134*b*. It operates similarly to jet 80, but the water passing through the jet 80 goes through the two off-angle outlets 134, 134*b*, causing the eyeball 132 to rotate.

Figure 15:
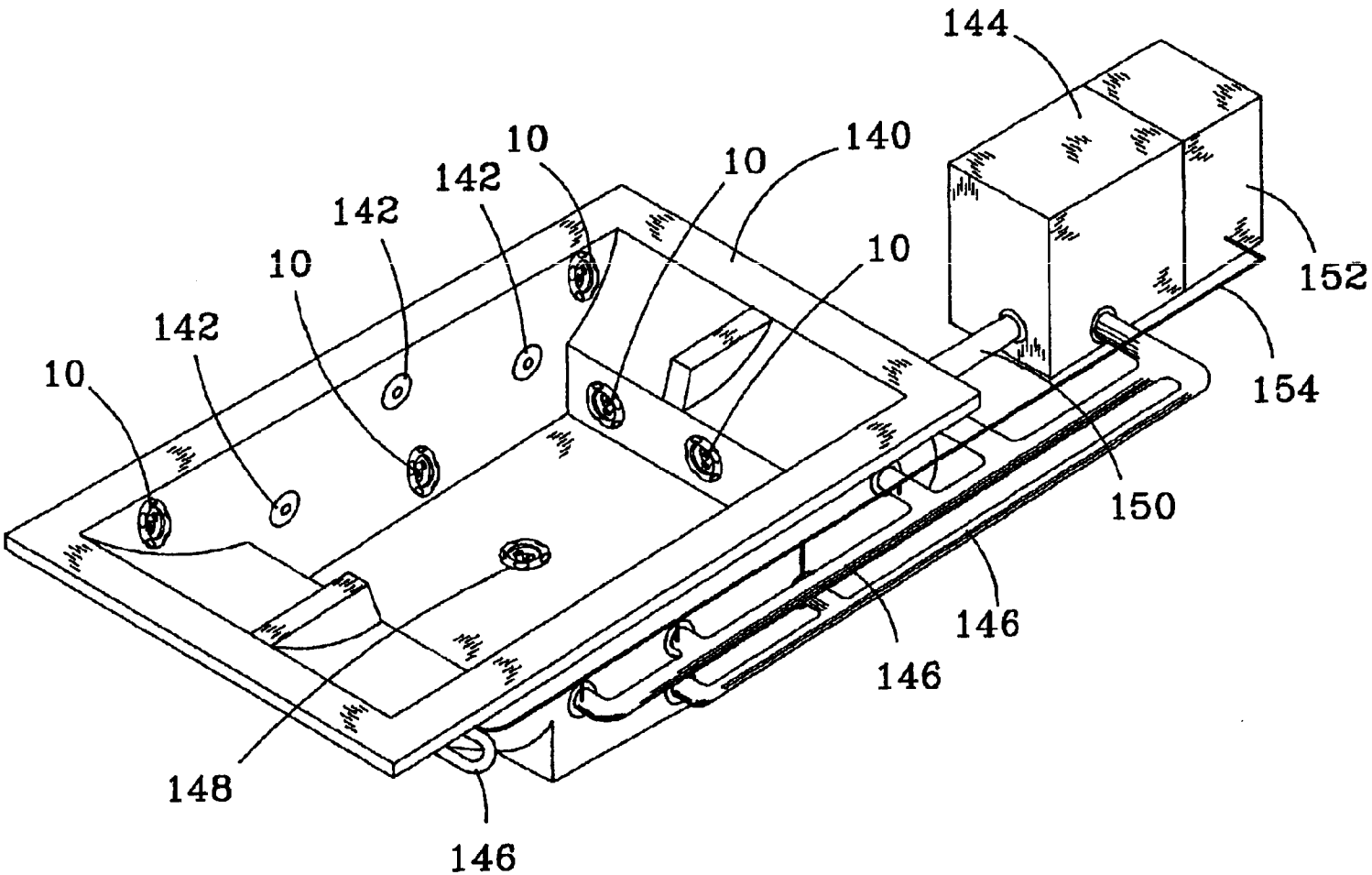
FIG. 15 is a perspective view of a spa/tub system using a jet according to the present invention.

As shown in FIG. 15, multiple jets can be installed in a spa or tub shell 140. Some or all of the jets can be one of the jets described above, with the jets in this embodiment being jet 10. The remaining jets can be any other desired type, such as a variety of prior single nozzle jets 142. Both types of jets are connected to a water pump 144, used to circulate the water throughout the spa system, by a series of water conduits 146. Water from shell 140 is provided to pump 144 through the drain 148, which is connected through return water conduit 150 to pump 144. Water from pump 144 is provided back to shell 140 by conduits 146, where it flows into jets 10 and 142, as the case may be, and in turn into shell 140, completing the loop. Additionally, an air system 152 can be included that provides air to individual jets 10 and 142 through an air conduit 154, to aerate the water flowing through the jet. The air system 152 can be pump driven to increase the pressure of the air entering the jet 10, or can be vacuum based with the venturis located within the jets 10 drawing air into the jets 10 and water flow stream.

Although the present invention has been described in considerable detail with reference to certain preferred configurations, other versions are possible. The invention can be used in many different types of hydrotherapy jets. Different outlets and eyeballs can be used, and different pin arrangements can be used to hold the eyeball in the body. Other jets can also have a water outlet alone, without air. Therefore, the spirit and scope of the appended claims should not be limited to their preferred versions described above.

What is claimed is:

1. A hydrotherapy jet, comprising:

a jet body having a longitudinal cavity;

a water inlet to allow water to flow into said body and to flow along said longitudinal cavity;

said body further comprising a fin downstream from said water inlet and projecting at least partially into said longitudinal cavity from an inside surface of said body, said fin not substantially interfering with the flow of water along said longitudinal cavity;

an outlet mounted to said body downstream from said fin and arranged to allow water to flow out of said body, the flow of water causing said outlet to rotate; and a retaining pin passing between said outlet and said fin and held at said fin to mount said outlet with respect to said body, said outlet rotating about said pin.

2. The jet of claim 1, further comprising a nozzle within said body and an air inlet into said body, said nozzle forming the water flowing into said body into a venturi, and said air inlet allowing air into said body to be entrained into said water.

3. The jet of claim 1, further comprising an escutcheon within said body which houses said outlet.

4. The jet of claim 3, wherein said escutcheon is rotatable to control the amount of water flowing through said body.

5. The jet of claim 1, wherein said retaining pin extends through an axial bore in said outlet and includes an outlet retainer.

6. The jet of claim 1, wherein said fin further comprises an axial bore along the jet body axis within which said pin is carried.

7. The jet of claim 1, wherein said retainer pin passes through said outlet and further comprises a head to retain said outlet.

8. The jet of claim 5, said axial bore has an enlarged forward end, and said retainer pin having an outlet retainer in the enlarged forward bore end.

9. The jet system of claim 1, wherein said outlet is angled to provide a turning moment in response to water flowing through it.

10. A hydrotherapy jet, comprising:

a jet body;

a water inlet to allow water to flow into and through said body;

an eyeball mounted to said body, said eyeball having one or more outlets to allow water to flow out of said body through said outlets, the flow of water causing said eyeball to rotate;

a fin projecting from an inside surface of said body at least partially into said longitudinal cavity, said fin not substantially interfering with the flow of water along said longitudinal cavity; and a retaining pin mounted between said eyeball and fin within said body and held at said fin holding said eyeball to said body, said eyeball rotating around about said pin.

11. The jet of claim 10, wherein said retaining pin extends through an axial bore in said eyeball and includes an eyeball retainer.

12. The jet of claim 10, wherein said pin is substantially elongate, said fin further comprising an axial section, said pin mounted to said axial section.

13. The jet of claim 10, further comprising a pin retainer having an axial bore along the jet body axis within which said pin is carried.

14. The jet of claim 10, wherein said retainer pin, further comprises a head to retain said eyeball.

15. The jet of claim 11, wherein said axial bore has an enlarged forward end, and said retainer pin having an eyeball retainer in the enlarged forward bore end.

16. The jet of claim 4, wherein said one or more outlets are angled to provide a turning moment in response to a water flow.

17. A hydrotherapy jet system, comprising:

a reservoir shell capable of holding water;

a plurality of hydrotherapy jets mounted around the reservoir shell;

a water pump system that circulates water from said reservoir to said jets; and selected one of said jets having one or more outlets providing a stream of water when said water pump is operated, said stream of water running through said outlets and causes it to rotate, a fin projecting into the interior of said selected one of said jets, said fin not substantially interfering with the flow of said stream of water;

and selected one of said jets further comprising a pin running between said one or more outlets to hold said outlets within said jet, said one or more outlets rotating about said pin.

18. The system of claim 17, further comprising an air system that provides an air intake to each of said jets.

19. The system of claim 17, wherein each of said jets, comprise:

a jet body;

a water inlet to allow water to flow into said body; and an eyeball mounted to said body, said outlets mounted to said eyeball, the flow of water through said outlets causing said eyeball to rotate, said retaining pin mounted within said body between said eyeball and said fin and holding said eyeball to said body, said eyeball rotating around said pin.

20. The system of claim 19, further comprising a nozzle within said body and an air inlet to said body, said nozzle forming the water flowing into said body into a venturi, and said air inlet allowing water into said body to be entrained into said water.

21. The system of claim 19, further comprising an escutcheon within said body which houses said eyeball.

22. The system of claim 21, wherein said escutcheon is rotatable to control the amount of water flowing through said body.

23. The system of claim 19, wherein said retaining pin extends through an axial bore in said eyeball and includes an eyeball retainer.

24. The system of claim 19, wherein said pin is substantially elongate, said fin further comprising an axial section, said pin mounted to said axial section.

25. The system of claim 19, further comprising a pin retainer having an axial bore along said jet body axis within which said pin is carried.

26. The system of claim wherein said retainer pin further comprises a head to retain said eyeball.

27. The system of claim 23, wherein said axial bore has an enlarged forward end, and said retainer pin having an eyeball retainer in the enlarged forward bore end.

28. The system of claim 19, wherein said one or more outlets are angled to provide a turning moment in response to a water flow.

29. A hydrotherapy jet, comprising:

a jet body having a longitudinal cavity;

a water inlet to allow water to flow into said body substantially along said longitudinal cavity;

said body further comprising a fin downstream from said water inlet and projecting at least partially into said longitudinal cavity, said fin not substantially interfering with the flow of water along said longitudinal cavity an outlet mounted to said body downstream from said fin and arranged to allow water to flow out of said body, the flow of water causing said outlet to rotate; and a retaining pin passing between said outlet and said fin and held at said fin to mount said outlet with respect to said body, said outlet rotating within.

30. The jet of claim wherein said fin further comprises a central bore and wherein said pin is press fit into said bore to hold said pin at said fin.

31. The jet of claim 29, wherein said pin is threaded on at least one end to mount said outlet with respect to said body, said pin either threaded into said outlet or said fin.

32. The jet of claim 29, wherein said pin is bonded on at least one end to mount said outlet with respect to said body, said pin either bonded to said outlet or said fin.

* * * * *

UNITED STATES PATENT AND TRADEMARK OFFICE

CERTIFICATE OF CORRECTION

PATENT NO. : 6,848,637 B2
DATED : February 1, 2005
INVENTOR(S) : Holtsnider

It is certified that error appears in the above-identified patent and that said Letters Patent is hereby corrected as shown below:

Column 8,
Line 25, delete "of claim 4" and insert -- of claim 10 --

Column 9,
Line 10, insert -- of claim 19 --

Column 10,
Line 11, insert -- of claim 29 --

Signed and Sealed this

Fifth Day of July, 2005

JON W. DUDAS
*Director of the United States Patent and Trademark Office*

UNITED STATES PATENT AND TRADEMARK OFFICE

CERTIFICATE OF CORRECTION

PATENT NO. : 6,848,637 B2
DATED : February 1, 2005
INVENTOR(S) : Holtsnider

It is certified that error appears in the above-identified patent and that said Letters Patent is hereby corrected as shown below:

Column 1,
Line 21, delete “steam” and insert -- stream --.

Column 2,
Line 7, delete “steam” and insert -- steam --.

Signed and Sealed this

Thirteenth Day of September, 2005

JON W. DUDAS
*Director of the United States Patent and Trademark Office*

UNITED STATES PATENT AND TRADEMARK OFFICE

CERTIFICATE OF CORRECTION

PATENT NO. : 6,848,637 B2
DATED : February 1, 2005
INVENTOR(S) : Holtsnider

It is certified that error appears in the above-identified patent and that said Letters Patent is hereby corrected as shown below:

Column 1,
Line 21, delete “steam” and insert -- stream --.

Column 2,
Line 7, delete “steam” and insert -- stream --.

This certificate supersedes Certificate of Correction issued September 13, 2005.

Signed and Sealed this

Eighteenth Day of October, 2005

JON W. DUDAS
*Director of the United States Patent and Trademark Office*